United States Patent [19]

Honer

[11] Patent Number: 4,679,263

[45] Date of Patent: Jul. 14, 1987

[54] HEAD SUPPORTED PILLOW

[76] Inventor: William A. Honer, Rt. 1, Box 202, Flowery Branch, Ga. 30542

[21] Appl. No.: 782,870

[22] Filed: Oct. 2, 1985

[51] Int. Cl.[4] ..... A47C 20/02

[52] U.S. Cl. ..... 5/437; 5/442

[58] Field of Search ..... 5/434, 435, 436, 437, 5/442, 441, 455, 465; 128/205.25, 134, 208.18, 87 B, 89 A

[56] References Cited

U.S. PATENT DOCUMENTS

| | | | |
|---|---|---|---|
| 2,167,622 | 8/1939 | Bentivoglio | 5/434 X |
| 3,933,154 | 1/1976 | Cabansag | 128/134 |
| 4,550,458 | 11/1985 | Fiore | 5/436 X |

*Primary Examiner*—Carl D. Friedman
*Assistant Examiner*—Naoko N. Slack
*Attorney, Agent, or Firm*—James B. Middleton

[57] ABSTRACT

A pillow carried on a person's head to hold the head in a natural position. The pillow includes a back cushion held against the back of the head, and side cushions held against the sides of the head. The side cushions are hinged to the back cushion to hold the rear ends together, and straps are fixed to the front of the side cushions to hold the front ends together. A flap is fixed to the back cushion, and extends over the top of the head and is fixed to the straps to prevent downward movement of the pillow. The back cushion may have an extension shaped to support the cervical region of the backbone in its natural shape.

4 Claims, 3 Drawing Figures

HEAD SUPPORTED PILLOW

INFORMATION DISCLOSURE STATEMENT

There are many forms of body supports designed to allow a person to sleep, or rest, comfortably. Most of these prior art devices include pillows, cushions and the like to fit beneath various parts of the body when a person is in bed in order to hold the various body parts in their most nearly normal, or natural, position. While several such devices have been commercialized to some extent, such prior art arrangements lack the convenience and versatility needed in everyday life.

SUMMARY OF THE INVENTION

This invention relates generally to body supported cushions, and is more particularly concerned with a pillow selectively attachable to a person's head for providing comfortable support for the person's head.

The present invention provides a pillow means having a plurality of cushions adapted to support the head while the body is in a plurality of different positions. The pillow means also provides for the partial obscuring of perceptions while maintaining the pillow means in the desired position on the person's head. More particularly, the pillow means includes cushions for engaging a person's ears to exclude sound to a large extent, and includes optional means for covering a person's eyes to exclude light to a large extent. The plurality of cushions is fixed to the person's head by strap means, and is held in place by a top flap, the entire assembly being easily releasable.

The present invention therefore provides a pillow means that can be carried by a person's head, and provide adequate support for a person's head whether the person is in a conventional bed, or is attempting to rest in a chair or other somewhat unconventional facility.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
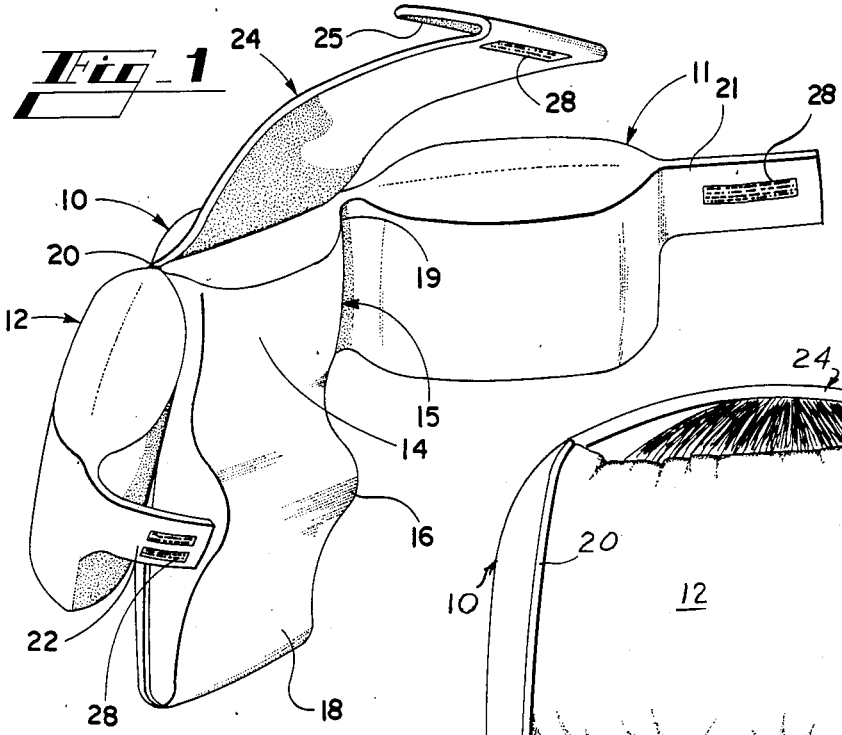
FIG. 1 is a perspective view showing pillow means made in accordance with the present invention, the various parts being opened outwardly to show their construction.

Referring now more particularly to the drawings, and to that embodiment of the invention here presented by way of illustration, it will be seen in FIG. 1 that the pillow means includes a plurality of cushions. The cushions include the back cushion generally designated at 10, the lefthand cushion generally designated at 11 and the righthand cushion generally designated at 12. It should be understood that the lefthand cushion 11 is adapted to engage the left side of a person, and the righthand cushion 11 is adapted to engage the right side of a person. These directions will be utilized throughout the description.

In more detail, it will be seen that the back cushion 10 is shown as including a head receiving recess 14 in a generally rectangular cushion area 15. Depending from the rectangular cushion member 15, there is a cervical support area designated at 16. It will be understood that the conformation of the front surface of the back cushion 10 will be designed to conform to the back of a person, beginning with the back of a head in the recess 14, extending to the neck area with the cervical support area 16, and perhaps extending slightly into the thoracic region at the extending lower end 18.

Though materials for construction of the pillow may vary, it is contemplated that the cushion 10, for example, will include a flexible foam appropriately shaped as described. This foam cushion can then be covered in fabric or the like to provide a pleasing surface. The fabric enclosing the foam cushion will preferably extend to the left- and right-hand cushions 11 and 12; and, with such construction, it will be understood that the fabric itself can provide hinges such as the hinges 19 and 20 between the back cushion 10 and the left- and right-hand cushions 11 and 12.

Looking now at the lefthand cushion 11, it will be seen that the cushion 11 is generally a rectangular body. The lefthand cushion 11 will be a foam cushion or the like covered in fabric as previously described, and the fabric can extend forwardly to provide the strap 21. It will be observed that the strap 21 is adjacent to the upper edge of the cushion 11, and this will be discussed in more detail hereinafter.

The righthand cushion 12 is a mirror image of the lefthand cushion 11, and the righthand cushion 12 has the strap 22 extending therefrom, also from the upper edge of the cushion 12.

From the back cushion 10, it will be noticed that there is a support flap generally designated at 24. This support flap 24 may be a single thickness of fabric if desired, and ideally may be a quilted material to provide sufficient softness for comfort. The construction of the flap 24 must be such that the flap is very flexible as will be apparent from the description below.

The forward edge of the flap 24 includes a visor 25. In FIG. 1 the visor 25 is shown folded, and almost lying against the flap 24. It is contemplated that hook and teasel material, or other fastening means, will be used to allow the visor 25 to be fixed to the flap 24 when desired, and to be easily released for use.

Figure 2:
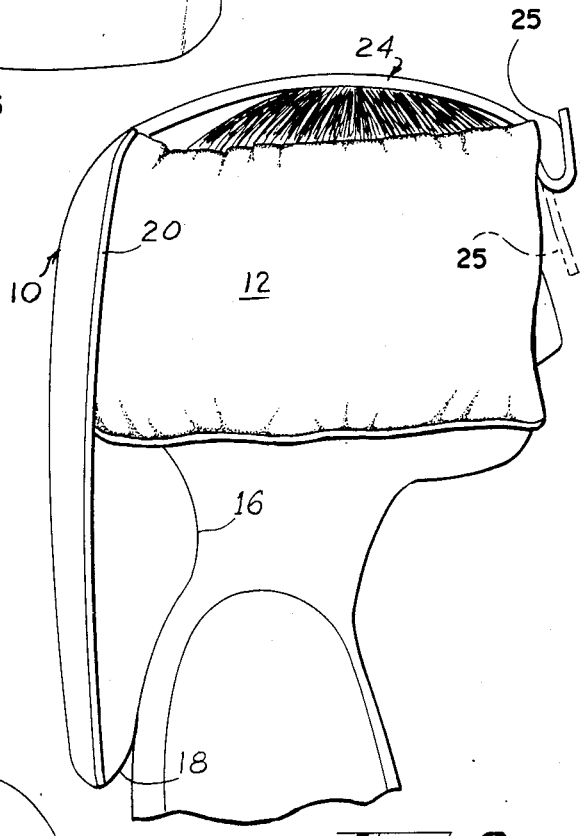
FIG. 2 is a side elevational view of a person having the pillow shown in FIG. 1 secured to his head; and, FIG. 3 is a top plan view of the arrangement shown in FIG. 2.
Figure 3:
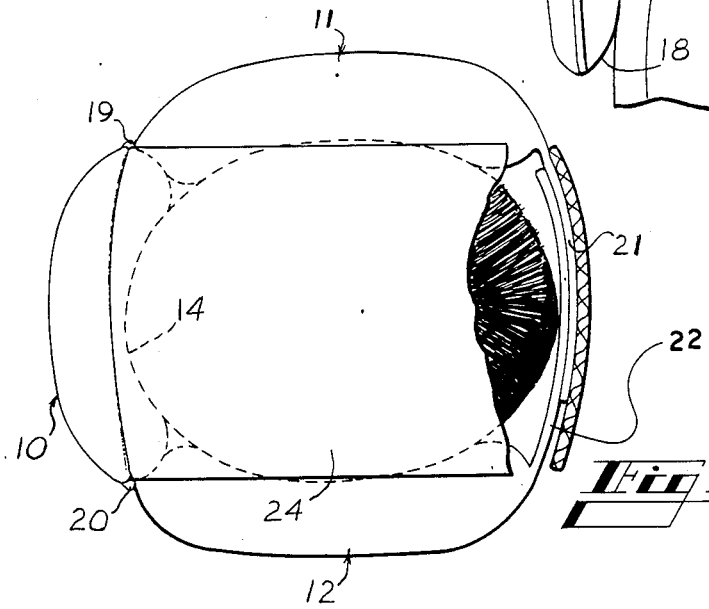

Looking now at FIGS. 2 and 3 of the drawings along with FIG. 1, it will be understood that, in order to use the pillow arrangement shown in FIG. 1, a person will place the cushion 10 against the back of his head with the cervical support 16 appropriately placed at the neck of the person. Next, the cushions 11 and 12 will be brought together and urged against the sides of the head of the person, thereby covering the ears. The straps 21 and 22 will be brought across the forehead as shown in FIG. 2, and it will be understood that the dimensions of the strap 21 and 22 will be such that the straps remain on the forehead without obstructing the vision. Fastening means, such as hook and teasel material, is indicated at 28, and those skilled in the art will realize that the hook material and the teasel material must be appropriately placed so that two different types of material will come together to form a fastening means.

In using the straps 21 and 22, by way of example, the strap 22 may have a soft rear surface, with teasel material at 28. The strap 22 will then be placed directly against the forehead, and the strap 21 will have hook material at 28 so the strap 21 can be pulled across and mated with the teasel 28 to hold the cushions 11 and 12 tightly against the head of the person. With the cushions 11 and 12 in place, the support flap 24 can be pulled across the top of the person's head. Again, hook and teasel material can be utilized to hold the front end of the flap 24 in place against the strap 21. Thus, the strap 21 may have hook material on its opposite surface, and the material 28 on the flap 24 may be teasel material.

The installation described is shown in FIGS. 2 and 3 of the drawings, and it will be seen that the cushions 11 and 12 are snugly against the sides of the head of the person, and the flap 24 extends across the top of the head of the person so the pillow cannot slide downwardly, but will remain in place.

With special attention to FIG. 2, it will be seen that the visor 25 is folded up and will be held in position by, for example, hook and teasel material. Nevertheless, if the person desires to shut out light, the visor 25 can be pulled downwardly to the position shown in broken lines in order to exclude light and allow a person to rest more comfortably.

Part of the inventive concept is the ability to use the pillow of the present invention on a bed or the like and provide adequate support for the person's head in all positions. With this in mind, it will be understood that the lefthand and righthand cushions 11 and 12 may be thick enough to extend generally to a person's shoulder so a person can rest on his side, shoulder down, and have the head supported in its natural state. Alternatively of course, the cushions can be smaller and adapted to provide comfort while sitting in a chair, or simply for those who prefer smaller pillows. Also, it will be seen that the back cushion 10 can easily terminate at the same level as the side cushions 11 and 12 in the event the cervical support area is not required. It is further contemplated that audio speakers or the like may be provided in the pillow of the present invention pillow speakers being well known in the art so they could be provided in conventional fashion.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A pillow for supporting the head of a person, said pillow including a plurality of cushions, and means for hinging said plurality of cushions with respect to one another, said pillow including a back cushion engageable with the back of said person's head, a lefthand cushion engageable with the left side of said person's head, said lefthand cushion being hinged to said back cushion, a righthand cusion engageable with the right side of said person's head, said righthand cushion being hinged to said back cushion, said back cushion being of a size and shape to receive the back of said person's head and extend laterally substantially to the sides of said person's head and including a left edge and a right edge, said lefthand cushion having a rear end generally contiguous with said left edge of said back cushion and a front end lying generally at the edge of said person's face, said lefthand cushion having a height sufficient to cover the left side of said person's head above the neck of said person, said righthand cushion having a rear end generally contiguous with said right edge of said back cushion and a front end lying generally at the edge of said person's face, said righthand cushion having a height sufficient to cover the right side of said person's head above the neck of said person, said means for hinging said plurality of cushions with respect to one another including a first hinge means for hinging said rear end of said lefthand cushion to said left edge of said back cushion, and second hinge means for hinging said rear end of said righthand cushion to said right edge of said back cushion, the arrangement being such that said back cushion holds the rear end of said right- and lefthand cushions with respect to each other, said back cushion, said righthand cushion and said lefthand cushion having a thickness such that the head of said person is held in a substantially natural position when said person is reclining, said pillow further including strap means extendable along the forehead of said person for holding the front ends of said right- and lefthand cushions with respect to each other with said cushions against said person's head, said strap means including releasable fastening means.

2. A pillow as claimed in claim 1, and further including support means for preventing downward movement of said pillow with respect to said person, said support means including a support flap having a first end fixed to said back cushion, said support flap being flexible and extendable across the top of the head of said person, and including a second end of said flap and releasable attaching means for selectively fixing said second end of said support flap to said strap means.

3. A pillow as claimed in claim 2, and a visor carried by said second end of said support flap and selectively extendable downwardly to cover the eyes of said person.

4. A pillow as claimed in claim 3, said back cushion further including a depending portion, said depending portion comprising a cervical support extending downwardly to receive the neck of the person, said cervical support conforming to the cervical region of said person.

* * * * *